US010024101B2

(12) United States Patent
Kollman et al.

(10) Patent No.: US 10,024,101 B2
(45) Date of Patent: Jul. 17, 2018

(54) BOTTOM RAIL FOR A CORDLESS BLIND

(71) Applicant: Lumino, Inc., Madison, WI (US)

(72) Inventors: Michael Kollman, Fitchburg, WI (US); Brooks Vrooman, Mount Horeb, WI (US)

(73) Assignee: Lumino, Inc., Madison, WI (US)

( * ) Notice: Subject to any disclaimer, the term of this patent is extended or adjusted under 35 U.S.C. 154(b) by 0 days.

(21) Appl. No.: 15/363,010

(22) Filed: Nov. 29, 2016

(65) Prior Publication Data

US 2018/0148973 A1 May 31, 2018

(51) Int. Cl.
*E06B 9/388* (2006.01)
*E06B 9/78* (2006.01)
*E06B 9/32* (2006.01)

(52) U.S. Cl.
CPC ..... *E06B 9/388* (2013.01); *E06B 9/32* (2013.01); *E06B 9/78* (2013.01)

(58) Field of Classification Search
CPC . E06B 9/388; E06B 9/325; E06B 9/78; E06B 2009/3222
USPC ..... 160/168.1 R, 170, 176.1 R, 178.1 R, 160/349.1; 52/843, 844; 256/59; D25/41.1, 121
See application file for complete search history.

(56) References Cited

U.S. PATENT DOCUMENTS 2,529,229 A * 11/1950 Sherwood ..... E06B 9/305 160/168.1 R
2,545,568 A * 3/1951 Bruner ..... E06B 9/388 160/178.1 R
2,623,581 A * 12/1952 Nelson ..... E06B 9/388 160/173 R
2,637,382 A * 5/1953 Nelson ..... E06B 9/388 160/178.1 R
2,643,713 A * 6/1953 Mayer ..... E06B 9/388 160/178.1 R
D173,504 S * 11/1954 Lorentzen ..... D6/580
2,817,398 A * 12/1957 Moyer ..... E06B 9/388 160/177 R
3,414,236 A * 12/1968 Siegal ..... E04F 11/1812 256/22
3,447,586 A * 6/1969 Anderle ..... E06B 9/325 160/178.1 R
4,441,540 A * 4/1984 Tsuhako ..... E06B 9/388 160/168.1 R
4,557,309 A * 12/1985 Judkins ..... E06B 9/262 160/279
4,758,824 A * 7/1988 Young ..... G08B 13/08 160/10
4,805,879 A * 2/1989 Spera ..... E04F 11/181 256/22
4,864,712 A * 9/1989 Carden ..... B21C 37/102 29/469.5

(Continued)

*Primary Examiner* — Robert Canfield

(74) *Attorney, Agent, or Firm* — Buchanan Ingersoll & Rooney PC

(57) ABSTRACT

A bottom rail for a cordless blind has an elongated body having a bottom, a top spaced apart from and substantially parallel to the bottom, a concave front face connected between the bottom and the top and a concave rear face connected between the bottom and the top. The concave surfaces provide comfortable gripping areas enabling a user to easily grasp the bottom rail and raise or lower the cordless blind.

10 Claims, 4 Drawing Sheets

(56) References Cited

U.S. PATENT DOCUMENTS 5,049,424 A * 9/1991 Carden ..... B21C 37/102 160/178.1 R
5,069,264 A * 12/1991 Klawiter ..... E06B 9/325 160/178.1 R
5,544,866 A * 8/1996 Dye ..... E04F 11/1836 256/59
5,655,590 A * 8/1997 Bryant ..... E06B 9/382 160/168.1 R
5,788,224 A * 8/1998 Platt ..... E04H 17/1421 256/19
6,053,236 A 4/2000 Judkins et al.
6,062,292 A * 5/2000 Bryant ..... E06B 9/303 160/173 R
D443,456 S * 6/2001 Horsten ..... D6/580
6,527,469 B1 * 3/2003 Erwin ..... E04F 11/181 256/1
6,874,766 B2 * 4/2005 Curatolo ..... E04F 11/1817 256/59
D544,966 S * 6/2007 Seiling ..... D25/122
7,228,797 B1 6/2007 Hillman et al.
D552,760 S * 10/2007 Seiling ..... D25/122
7,281,563 B2 * 10/2007 Wu ..... E06B 9/32 160/170
D560,823 S * 1/2008 Holland ..... D25/122
7,438,284 B2 * 10/2008 McGinness ..... E04F 11/1812 256/59
7,543,802 B2 * 6/2009 Petta ..... E04F 11/1812 256/59
D661,813 S * 6/2012 Walker ..... D25/38.1
8,251,120 B2 8/2012 Chen
8,739,853 B2 6/2014 Judkins
9,187,952 B2 * 11/2015 Vestal ..... E06B 9/324
9,212,519 B2 * 12/2015 Vrooman ..... E06B 9/367
D753,413 S * 4/2016 Anderson ..... D6/580
9,316,050 B2 4/2016 Hsu et al.
9,482,028 B2 * 11/2016 Springborn ..... E04H 17/1421
9,759,008 B2 * 9/2017 Anderson ..... E06B 9/388
2003/0085395 A1 * 5/2003 Gardner ..... E04F 11/181 256/65.02
2005/0127346 A1 * 6/2005 Steffes ..... A47H 1/104 256/65.05
2006/0175024 A1 * 8/2006 Wu ..... E06B 9/388 160/178.1 R
2007/0272364 A1 11/2007 Liang
2008/0087387 A1 * 4/2008 Chen ..... E06B 9/388 160/173 R
2008/0265232 A1 * 10/2008 Terrels ..... E04F 11/181 256/65.04
2009/0025888 A1 * 1/2009 Brace ..... E06B 9/262 160/84.05
2013/0112353 A1 5/2013 Sengelaub
2014/0014279 A1 * 1/2014 Defenbaugh ..... E06B 9/68 160/168.1 P

* cited by examiner

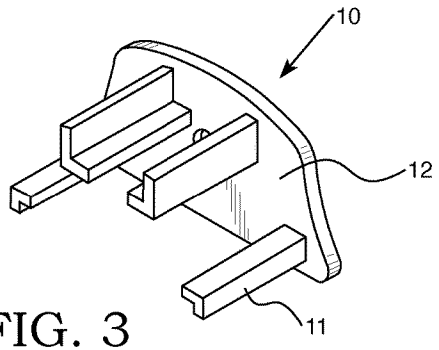
FIG. 3
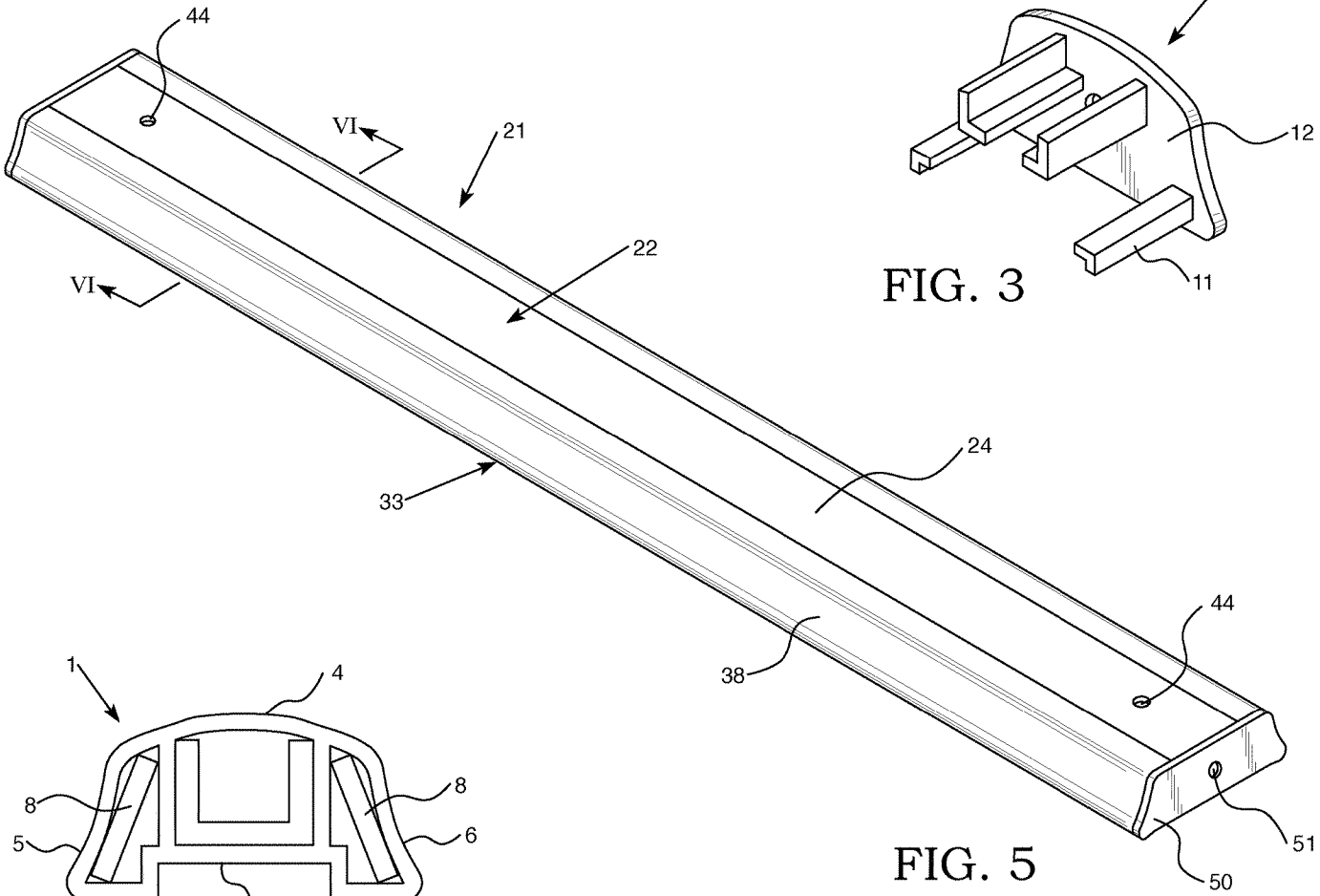
FIG. 5
FIG. 4

BOTTOM RAIL FOR A CORDLESS BLIND

FIELD OF INVENTION

The present invention relates to a bottom rail for window coverings which have lift cords, such as Venetian blinds, pleated shades and cellular shades.

BACKGROUND OF THE INVENTION

Venetian blinds, pleated shades and cellular shades have a top rail, a bottom rail and a window covering material which extends between the top rail and the bottom rail. Lift cord extend from the bottom rail, through the window covering material and into the headrail, The lift cords may pass through a cord lock or be wound on spools attached to a common axle or wound on a roller or tube within the headrail. The axle, roller or tube may be driven by a motor, by a cord loop drive or by spring motors within the headrail or the bottom rail. Those window coverings which have spring motors are commonly called cordless blinds or cordless shades.

To operate a cordless shade the operator must grasp the bottom rail and pull the bottom rail down to close the shade or push the bottom rail up to open the shade. It may take as much as ten pounds of force to pull the bottom rail down in some cordless shades. Most bottom rails have a flat front surface and a flat rear surface. The hand of an operator can easily slip from a bottom rail which is grasped by these surfaces. It is often difficult to grasp a bottom rail by extending one's fingers over the top edges of the bottom rail because slats of a Venetian blind or fabric of a pleated shade or cellular shade is stacked on the bottom rail. Attempting to do that on a pleated shade or cellular shade could soil the fabric that the operator touches.

Cylindrical bottom rails have been used and are easier to grasp than rectangular bottom rails. But cylindrical bottom rails are easily dislodged when the shade is in a fully lowered position and the bottom rail is resting on a window sill.

The art has attached one or more short handles to the bottom rail that extend outward from the front and/or rear of the bottom rail. These handles often are centered on the bottom rail and made of a clear plastic. These handles detract from the appearance and add to the cost of the bottom rails on which they are used.

Another solution that is disclosed in U.S. Pat. No. 8,739,853 B2 to Judkins is a pull rod having one end pivotably attached to the front surface of the bottom rail for pulling the bottom rail down. The pull rod can be stored against the bottom rail by a clip on the bottom rail. The pull rod can detract from the appearance of the bottom rail on which it is used and adds cost to the product.

In recent years there has been much concern in the window covering industry about child safety. Most of that concern has focused on preventing a child's head and neck from becoming entangled in lift cords used to raise and lower the blind that extend from the headrail or from becoming entangled is a cord loop used to raise and lower the blind. Because cordless blinds do not have cord loop drives or lift cords that extend from the headrail, sales of cordless blinds have been increasing.

Consequently, there is a need for a bottom rail for cordless blinds that can be easily and securely grasped when raising or lowering the cordless blind.

SUMMARY OF THE INVENTION

We provide a bottom rail for a cordless blind which is an elongated body having a bottom, a top spaced apart from and substantially parallel to the bottom, a concave front face connected between the bottom and the top and a concave rear face connected between the bottom and the top. The concave surfaces provide comfortable gripping areas enabling a user to easily grasp the bottom rail and raise or lower the blind. The elongated body may be a plastic or metal extrusion. We prefer to use either polyvinyl chloride or aluminum. The elongated body can be one piece or multiple pieces. We prefer to provide a one piece body in the bottom rail for a one-inch Venetian blind and can make the body in the bottom rail for a two-inch Venetian blind as a one-piece body or a two piece body.

The elongated body is hollow along its length and may have longitudinal stiffening ribs. End caps are attached to each end of the bottom rail and weights can be placed in the bottom rail if needed to counterbalance the spring motors in the Venetian blind. We prefer to provide a hole or slot in each end cap which can receive the post of a hold down bracket.

Other objects and advantages of our bottom rail will become apparent from a description of certain present preferred embodiments shown in the drawings.

BRIEF DESCRIPTION OF THE FIGURES

FIG. 3 is a rear perspective view of the end cap in the embodiment shown in FIG. 1.

FIG. 4 is an end view of the embodiment of FIGS. 1 and 2 with the end cap removed showing optional weights that can be placed in the bottom rail.

FIG. 5 is a perspective view of a second present preferred embodiment of our bottom rail for a cordless blind.

DESCRIPTION OF THE PRESENT PREFERRED EMBODIMENTS

Figures 1, 2:
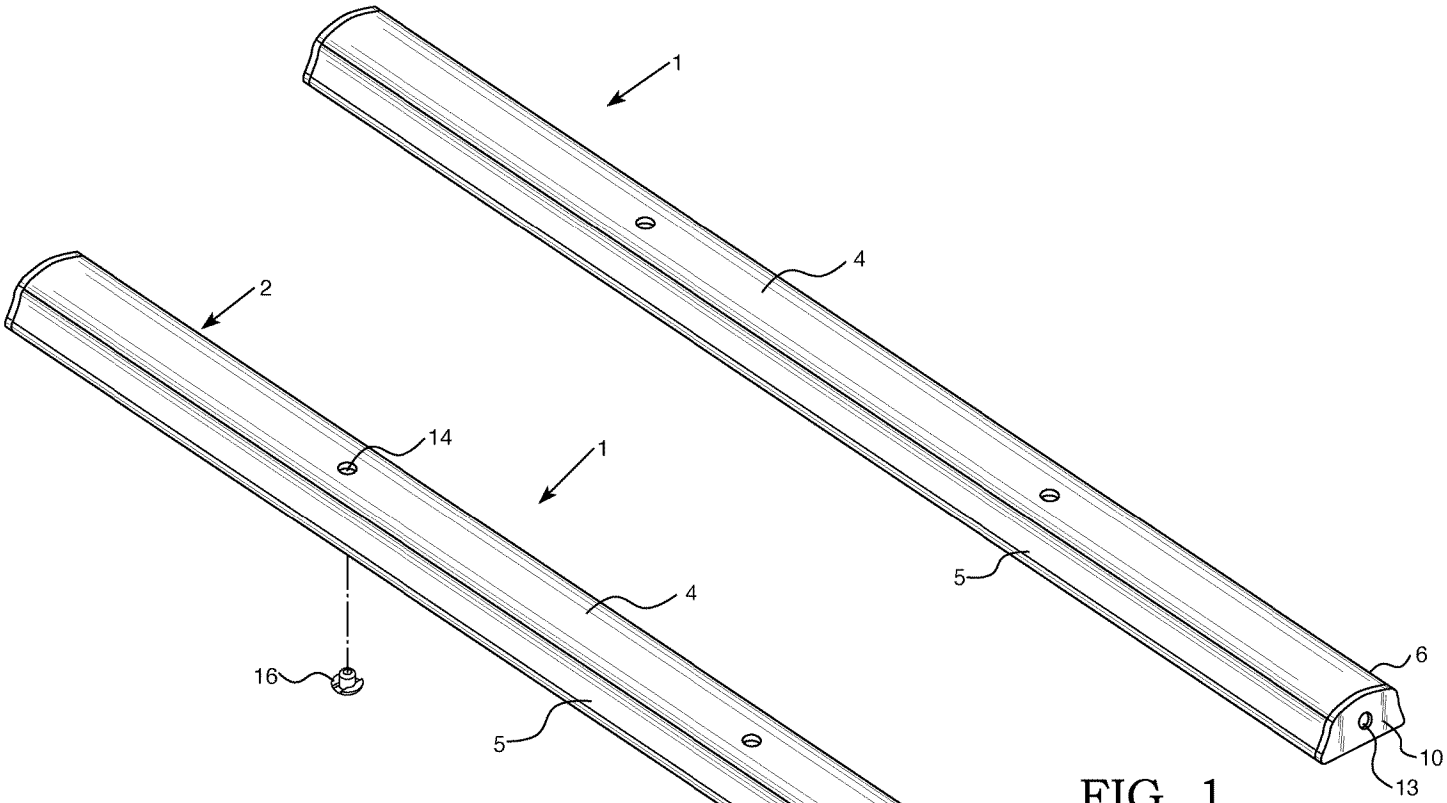
FIG. 1 is a perspective view of a present preferred embodiment of our bottom rail for a cordless blind.
FIG. 2 is an exploded view of the bottom rail shown in FIG. 1.
Figure 6:
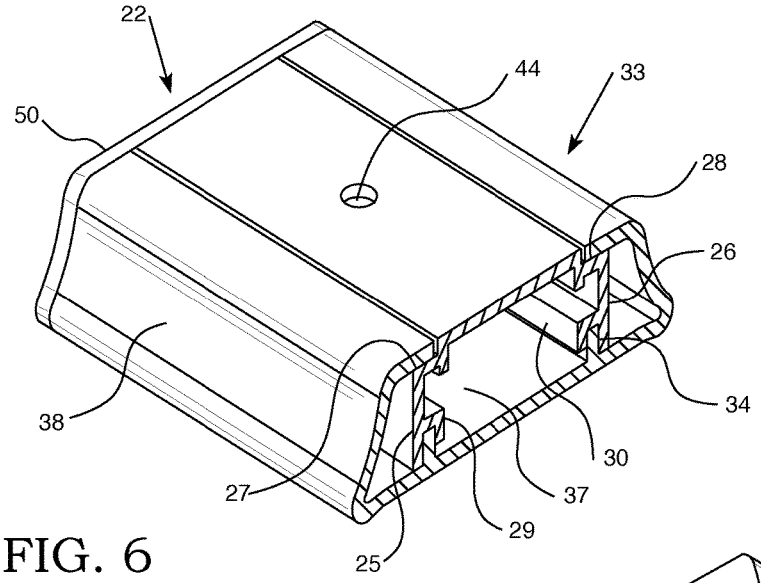
FIG. 6 is a sectional view taken along the line VI-VI in FIG. 5.

Referring to FIGS. 1-4 a first present preferred embodiment of our bottom rail 1 has an elongated body 2 having a bottom 3, a top 4 spaced apart from and substantially parallel to the bottom, a concave front face 5 connected between the bottom and the top and a concave rear face 6 connected between the bottom and the top. The front face and the rear face preferably are concave along their entire length from one end of the bottom rail to the other end of the bottom rail. Then a user can easily and securely grip the bottom rail at any point along its length to raise or lower the cordless blind. The top 4 is convex and is sized to receive curved slats of a Venetian blind.

The elongated body 2 is hollow and preferably has ribs 7 along its length. The ribs provide strength to the bottom rail and define cavities within the bottom rail. In some cordless blinds the weight of the bottom rail and the slats or other window covering material may not be sufficient to counterbalance the spring motor in the blind. In those blinds weights 8 may be placed in the bottom rail as shown in FIG. 4. End caps 10 are provided on each end of the bottom rail. As can be seen in FIGS. 2 and 3 the end caps 10 have a body 12 that is of the same size and shape as the ends of the elongated body 2. Prongs 11 extend from the rear of the end cap body 12 that fit into the end of the elongated body 2 to hold the end cap in place. We prefer to provide a hole 13 in the end cap which is sized to receive the post of a hold down bracket like that shown in FIG. 10.

Lift cords that pass through the Venetian blind slats or other window covering material of the cordless blind (not shown) go into the holes 14 on the top 4 of the bottom rail. We prefer provide plugs 16 that fit into corresponding holes in the bottom of the elongated body to receive and secure the lift cords.

A second present preferred embodiment 21 is shown in FIGS. 5-9. In this embodiment there is an elongated U-shaped body 22 having a flat top 24 an open bottom, a flat front 25 and a flat back 26. This body preferably is a plastic or metal extrusion. As can be seen most clearly in FIGS. 6 and 9 there is a first shoulder 27 connecting the front 25 to the top 24 and a second shoulder 28 connecting the back 26 to the top 24. A rail 29 on the inside of the front 25 and a rail 30 on the inside of the back 26 each define a channel. The channels and the shoulders are provided to receive a cover 33 which has ribs 34 that fit into the channels and arms 35, 36 that sit on the shoulders 27, 29. The cover has a flat bottom 37, a concave front face 38 connected between the bottom 37 and arm 35 and a concave rear face 39 connected between the bottom 37 and arm 36. The front face and the rear face preferably are concave along their entire length and provide a gripping surface for holding the bottom rail when raising or lowering the blind. The cover 33 is preferably made of polyvinyl chloride, but could be made of other plastics or metal, such as aluminum.

Figure 7:
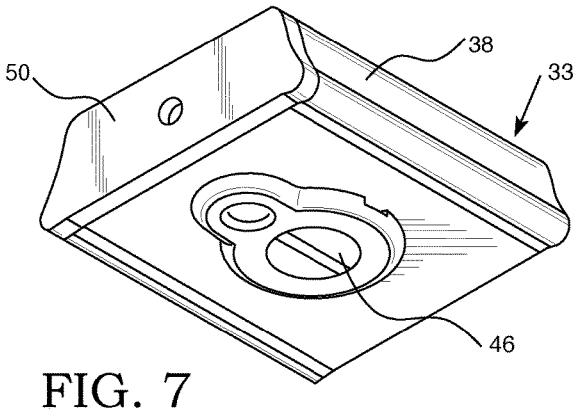
FIG. 7 is a bottom perspective view of the portion of the bottom rail shown in FIG. 6.
Figure 8:
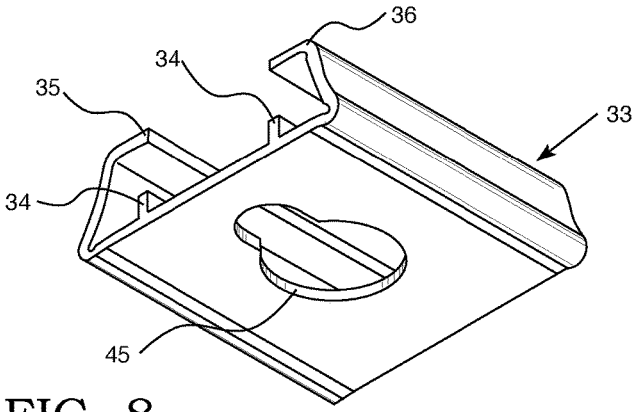
FIG. 8 is a bottom perspective view similar to FIG. 7 of the portion of the cover in the bottom rail shown in FIG. 6 after the end cap and plug have been removed.
Figure 9:
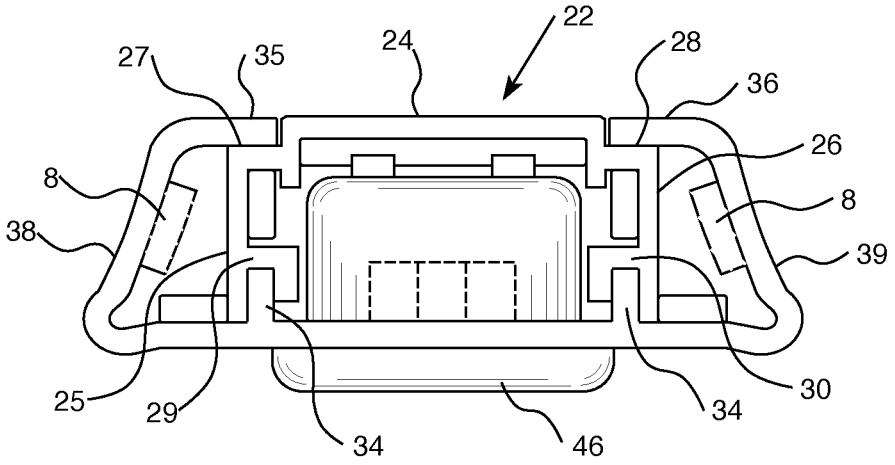
FIG. 9 is an end view of the embodiment of FIG. 5 with the end cap removed showing optional weights that can be placed in the bottom rail.

As in the first embodiment holes 44 are provided on the top 24 of the elongated body 22 for lift cords. A plug 46 is provided for each lift cord. The plugs 46 fit into holes 45 in the bottom 37 of the cover 33 to receive and secure the lift cords (not shown) as can be seen in FIGS. 7, 8 and 9. Furthermore weights 8 can be inserted into the elongated U-shaped body 22 or in the spaces between the cover 33 and the front and rear of the U-shaped body 22 as shown in FIG. 9.

Figure 10:
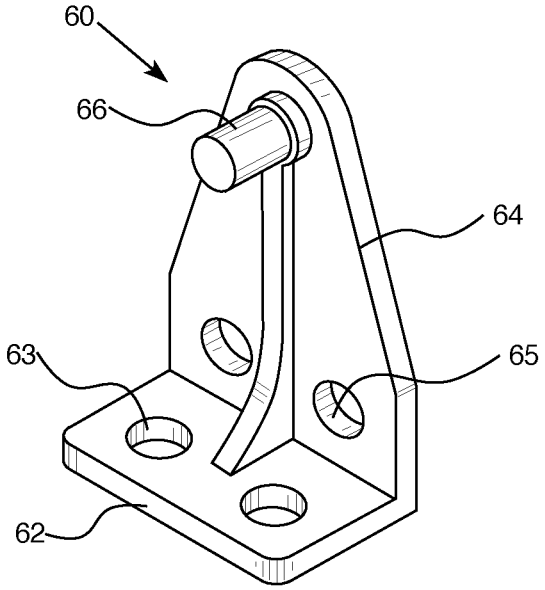
FIG. 10 is a perspective view of a hold down bracket that can be used with the bottom rails shown in FIGS. 1 and 5.

An end cap 50 similar to the end cap shown in FIG. 3 is inserted into each end of the bottom rail 21. A hole 51 is provided in each end cap 50 which is sized to receive the post 61 of the hold down bracket 60 that is shown in FIG. 10. That hold down bracket has a base 62 with mounting holes 63 and an upright 64 attached to the base 62. The upright 64 also has a pair of mounting holes 65. The base 62 of the hold down bracket can be attached to a window sill by screws (not shown) passing through the holes 63 in the base 62. The upright 64 can be attached to a side of a window frame by screws (not shown) passing through the holes 65 in the upright 64. A post 66 extends from the upright 64 and is sized to fit into the hole 13, 51 in the end cap 10, 50.

The concave front face and the concave rear face in our bottom rail not only provide a helpful gripping surface, but they also add to the strength of the bottom rail. A user of the bottom rail disclosed here can easily hold onto the bottom rail while applying a downward pull force of ten pounds to lower a cordless blind. In contrast, when a user grips the front and rear faces of a bottom rail having a flat front face and flat rear face his or her hand easily can and often does slip form the bottom rail when trying to pull the blind down. This is particularly true when it is necessary to apply ten pounds of downward force.

Although we have described and illustrated certain present preferred embodiments of our bottom rail for a cordless blind, our invention is not limited thereto but may be variously embodied within the scope of the following claims.

We claim:

1. A bottom rail for a cordless blind comprising: a U-shaped elongated body having a top, a first end, a second end, a front face and a rear face, the rear face being substantially parallel to the front face; and a cover having a bottom, an open top, a concave front face having an upper edge and a lower edge, the lower edge connected to the bottom, a concave rear face having an upper edge and a lower edge, the lower edge connected to the bottom, a first arm extending from the upper edge of the concave front face and a second arm extending from the upper edge of the concave rear face; wherein the cover is attached to the U-shaped elongated body in a manner so that bottom of the cover is substantially parallel to the top of the U-shaped elongated body, the concave front face of the cover overlaps the front face of the U-shaped elongated body, the concave rear face of the cover overlaps the rear face of the U-shaped elongated body, the first arm rests on the top of the U-shaped elongated body and the second arm rests on the top of the U-shaped elongated body.

2. The bottom rail of claim 1 wherein the bottom of the cover has a first width, the top of the U-shaped elongated body has a second width and the first width is greater than the second width.

3. The bottom rail of claim 1 wherein at least one of the U-shaped elongated body and the cover is aluminum or polyvinyl chloride.

4. The bottom rail of claim 1 also comprising:

a first endcap connected to the first end of the U-shaped elongated body; and a second endcap connected to the second end of the U-shaped elongated body.

5. The bottom rail of claim 1 also comprising at least one weight within the U-shaped elongated body.

6. The bottom rail of claim 1 wherein at least one of the U-shaped elongated body and the cover is an extrusion.

7. The bottom rail of claim 1 wherein the top of the U-shaped elongated body is flat.

8. The bottom rail of claim 1 also comprising at least on rib attached to the top of the U-shaped elongated body.

9. The bottom rail of claim 1 also comprising:

a first rail attached to the front face of the elongated U-shaped body such that the first rail and the front face define a first channel;

a second rail attached to the rear face of the elongated U-shaped body such that the second rail and the rear face define a second channel;

a first rib attached to the bottom of the cover and extending into the first channel; and a second rib attached to the bottom of the cover and extending into the second channel.

10. The bottom rail of claim 1 also comprising the top of the U-shaped elongated body having a first shoulder adjacent the front face of the U-shaped elongated body and a second shoulder adjacent the rear face of the U-shaped elongated body, wherein the first arm rests on the first shoulder and the second arm rests on the second shoulder.

* * * * *